US005426575A

United States Patent [19]

Richards

[11] Patent Number: 5,426,575

[45] Date of Patent: Jun. 20, 1995

[54] LUMINAIRES

[75] Inventor: Malcolm J. Richards, Aylesbury, United Kingdom

[73] Assignee: D. W. Windsor Limited, Hertforshire, United Kingdom

[21] Appl. No.: 204,415

[22] PCT Filed: Sep. 18, 1992

[86] PCT No.: PCT/GB92/01720

§ 371 Date: Mar. 15, 1994

§ 102(e) Date: Mar. 15, 1994

[87] PCT Pub. No.: WO93/06414

PCT Pub. Date: Apr. 1, 1993

[30] Foreign Application Priority Data

Sep. 20, 1991 [GB] United Kingdom ..... 9120129

[51] Int. Cl.[6] ..... F21V 7/00

[52] U.S. Cl. ..... 362/283; 362/282; 362/346; 362/301; 362/297

[58] Field of Search ..... 362/346, 278, 301, 281, 362/280, 297, 277, 282, 283

[56] References Cited

U.S. PATENT DOCUMENTS

| | | | |
|---|---|---|---|
| 3,213,271 | 10/1965 | Tolbert | 362/281 |
| 4,007,365 | 2/1977 | Stempfle et al. | 362/283 |
| 4,041,306 | 8/1977 | Compton et al. | 362/297 |
| 4,053,766 | 10/1977 | Brass | 362/297 |
| 4,616,296 | 10/1986 | Westgaard et al. | 362/301 X |
| 4,651,260 | 3/1987 | Lasker | 362/281 |
| 4,872,098 | 10/1989 | Romano | 362/283 |
| 4,979,086 | 12/1990 | Heinisch | 362/297 |

FOREIGN PATENT DOCUMENTS

| | | | |
|---|---|---|---|
| 1904982 | 8/1970 | Germany | 362/ |

*Primary Examiner*—Ira S. Lazarus
*Assistant Examiner*—Thomas M. Sember
*Attorney, Agent, or Firm*—Breiner & Breiner

[57] ABSTRACT

A luminaire has at least four reflectors which may be individually pivoted about an axis provided by a screw that the distribution of light emitted by a lamp located within the envelope of the reflectors may be altered and fixed to suit the environment that the luminaire is to illuminate.

8 Claims, 2 Drawing Sheets

FIG. 1
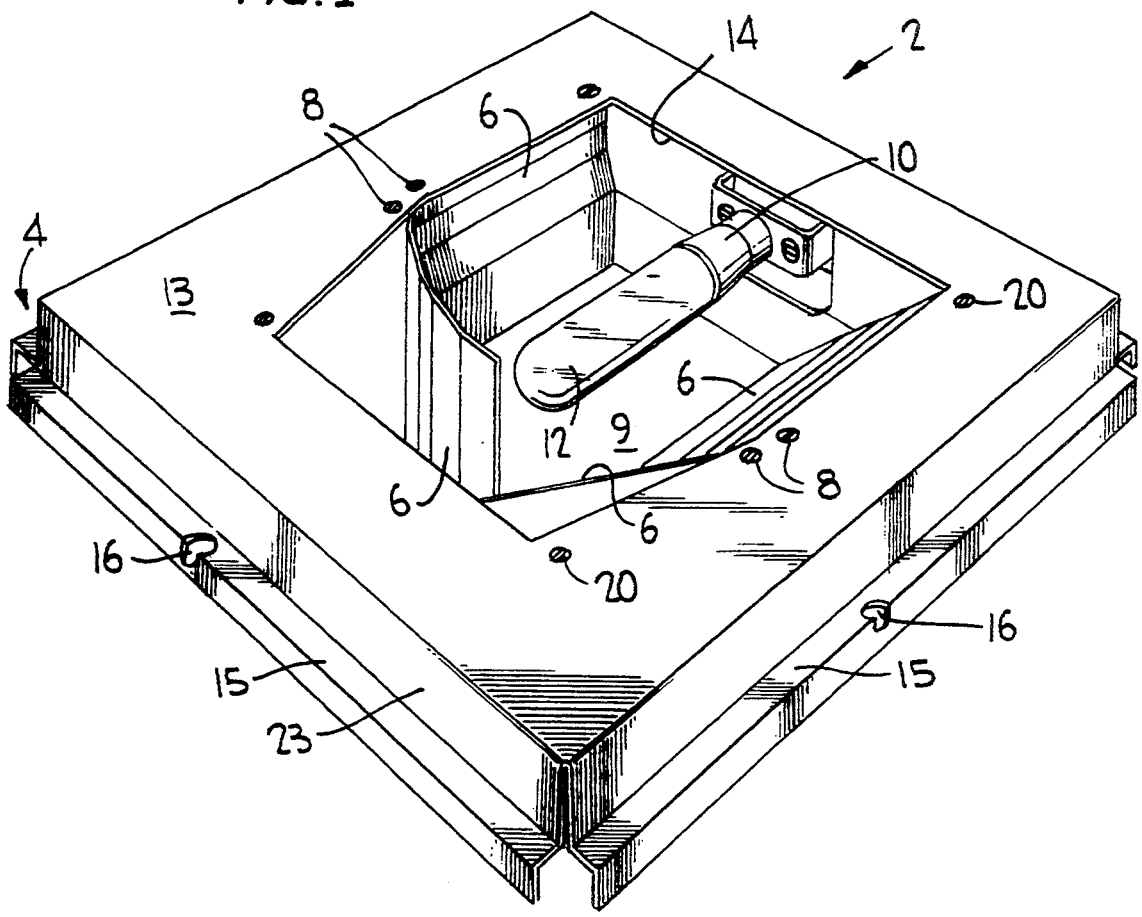
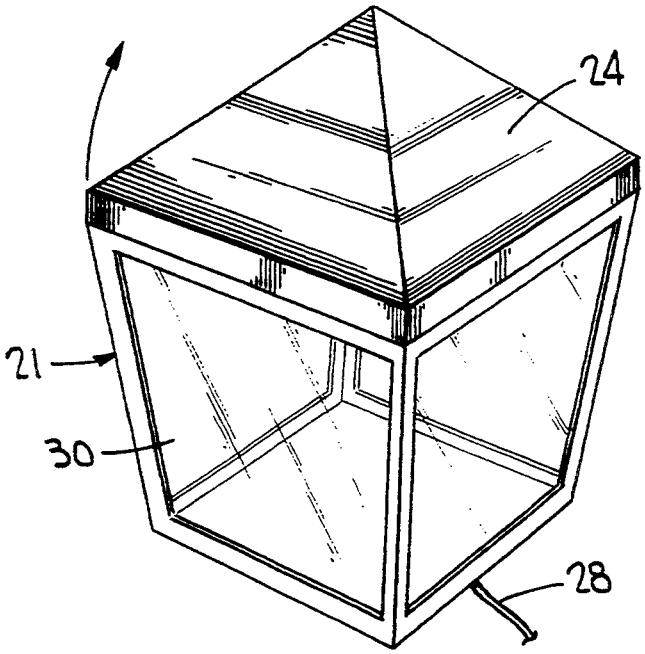
FIG. 2

LUMINAIRES

BACKGROUND OF THE INVENTION

This invention relates to luminaires, specifically to those for use in lighting situations in which it is not desired to achieve equal lighting at all positions illuminated by the luminaire. By the term 'luminaire' is meant an apparatus which distributes, filters and/or transforms light from one or more lamps mounted in the apparatus.

It is known that in some lighting situations it is desired not to light uniformly the complete surroundings to a luminaire, but to direct the light in particular directions, for example the luminaire for a street light specifically directs in a downwards direction most of the light emitted by the lamp. The distribution of the light is fixed by the luminaire.

In some situations the fixed light distribution does not prove to be a problem. There are, however, lighting situations, such as in a subway, where a luminaire of fixed light distribution may result in either a large wastage of light to ensure that all the area is adequately illuminated, which in a subway results in a higher than necessary degree of illumination of the walls and certain parts of the floor surface, or it may result in inadequate lighting of the entire area but not wastage of light.

Theoretically it would be possible individually to manufacture each luminaire so as to give the light distribution best suited to the proposed position in which the luminaire is to be mounted. This option, however, is not feasible economically.

It is known to manufacture luminaires with two reflectors of which each can swivel relative to a fixed lamp, to vary the distribution of illumination. It is also known to vary the distribution of illumination by moving the light source relative to the reflectors.

Neither of these options gives a very satisfactory range of light distribution.

SUMMARY OF THE INVENTION

According to the present invention there is provided a luminaire comprising a frame, a luminaire comprising a frame, having at least four reflectors mounted around an aperture in the frame to circumscribe a lamp position and to reflect light emitted from a lamp when in position, and in which the reflectors are pivotable, characterised in that each of the four reflectors is angularly adjustable about an axis extending perpendicularly to the frame and has a substantially-triangular base in slidable contact with one surface of an apertured base member of the frame, and the adjacent ends of a pair of reflectors on each side of a median axis of the aperture are engaged by one of a pair of contiguous pivot members.

The luminaire may be adapted to be located about a fixed lamp, or it may itself include a socket for a lamp. The socket (and thus the lamp) may be fixed or it may be movable in the frame relative to the reflectors to vary the pattern and distribution of illumination.

BRIEF DESCRIPTION OF THE DRAWINGS

The present invention will be further described and explained by way of example with reference to the accompanying drawings, in which:

FIG. 1 shows a perspective view of a luminaire according to the present invention in a preferred embodiment;

FIG. 2 shows a side elevation of a lantern fitted with a luminaire of the present invention;

DETAILED DESCRIPTION OF THE INVENTION

Figure 3:
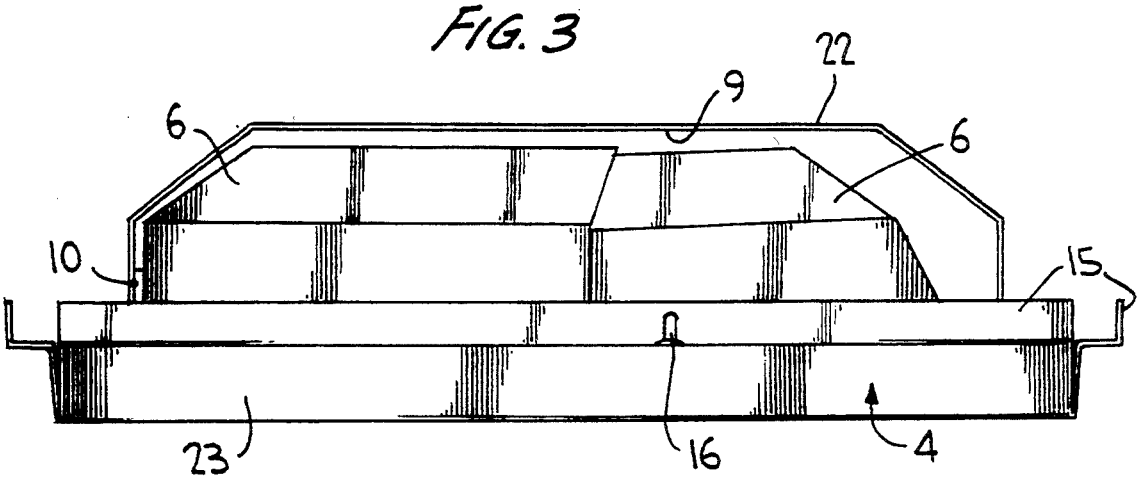
FIG. 3 is a side elevation of the luminaire of FIG. 1 in a position in which it throws light down.

Referring to the drawings, a luminaire 2 comprises a frame 4 on to which are pivotally attached four reflectors 6, each being attached by, and pivoting about the main axis of, a pivot screw 8, being locked in position by a lock screw 20. Also attached to frame 4 is a lamp holder 10, in which is a lamp 12. Although screws are described, other forms of pivots and clamps could be used. FIG. 1 is a perspective view of what would be the underside of the luminaire when mounted, as is usual, to direct downwards the light from lamp 12.

Frame 4 is in the form of a metal box, with a hexagonal aperture 14 in the base 13 of the box. The walls 23 of the box 4 are formed with flanges 15 in which are holes 16 by means of which screws or the like may be used to mount the luminaire in a lantern 21 (FIG. 2) able to be mounted at an appropriate height above the path or other surface to be lit at night.

Frame 4 may, in other embodiments, be of any substantially hollow form determined by the final desired shape of the luminaire.

Secured to, or integral with, the frame 4 is a U-shaped bracket 22 to which the lampholder 10 may be secured and of which an inside surface 9, opposite the aperture 14, is of a reflective white material or paint.

Each reflector 6 extends from near the rear reflective surface 9 to base 13, and is attached by at least the pivot screw 8 at one end of the reflector to the base adjacent to an edge of aperture 14.

The reflectors 6 and screws 8 are arranged so that on each side of the median axis of aperture 14 there are two reflectors 6 fixed with their screws 8 adjacent to each other and the reflectors extending away from each other.

Figure 4:
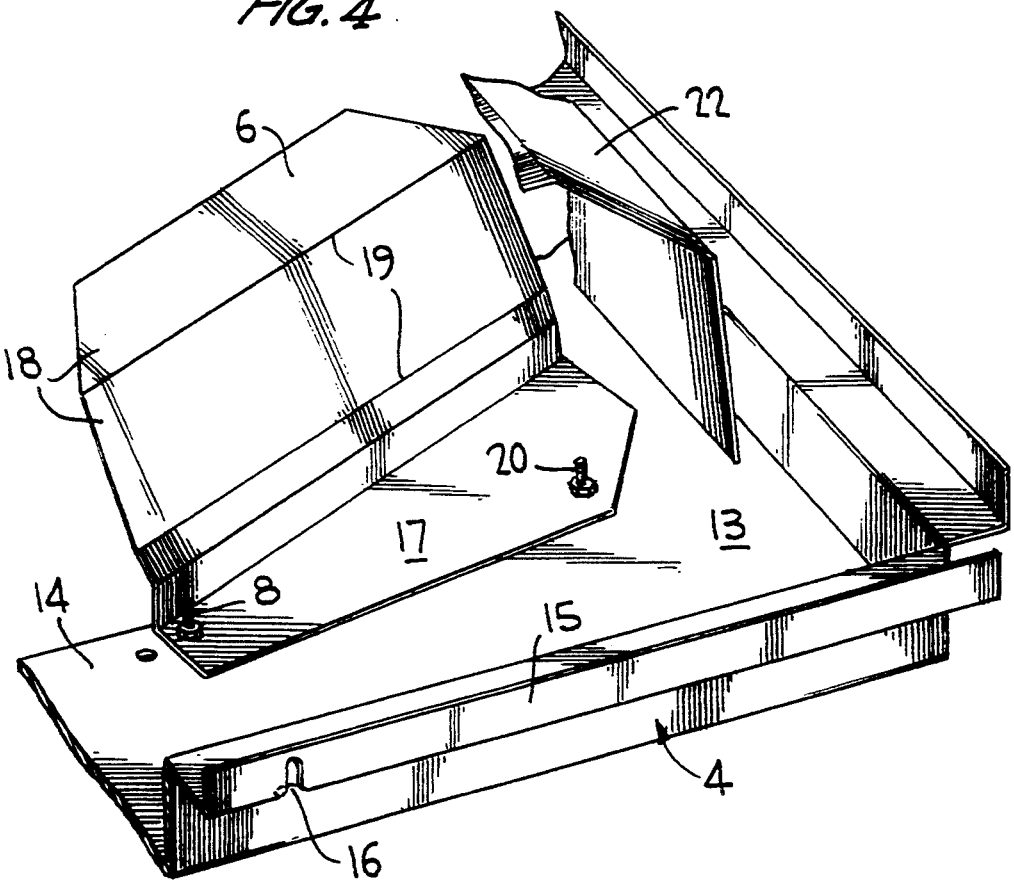
FIG. 4 is a scrap perspective view of one reflector in position.

As shown in FIG. 4, each reflector 6 has a substantially-triangular base 17 having the individual reflective facets 18 formed by folding the material of the reflector, such as polished aluminium sheet, about parallel fold lines 19.

When its respective pivot screw 8 is not tight, each reflector 6 is able to be pivoted about the main axis of the screw, the axis being substantially perpendicular to the base 13, with the base 17 of each reflector in sliding contact with the base 13. Each reflector 6 is of sufficient length for its base at all angular positions to overlap the edges of aperture 14. Each reflector 6 is of sufficient width, in the plane perpendicular to base 13, for its depth to be substantially the same as that between the base 13 and surface 9. In the preferred embodiment, each reflector comprises four substantially-rectangular plane facets angled to each other about a fold line, the major axis of each facet running substantially parallel to base 13. Preferably reflectors 6 are specular reflectors.

The lamp holder 10 is located between two free ends of the two adjacent reflectors 6.

In use, when the pivot screws 8 are loosely done up, the reflectors 6 may easily be pivoted to alter the light distribution from the luminaire 2. When the desired light distribution 2 has been achieved, either by trial and error or by way of predetermined settings, the pivot screws 8 are tightened and holes for lock screws 20 drilled and tapped, and the lock screws 20 inserted and tightened so that each reflector is held in position by two screws.

The lock and pivot screws hold each reflector in position during storage, transit and installation. If the reflector as so held is distributing light where needed, then lock screw 20 is kept in place, but otherwise it is removed to permit adjustment of each reflector by pivotal movement of the reflector about its pivot screw 8.

It may be seen that the ability to alter the position of the reflectors 6 enables a wide range of light distribution patterns to be achieved.

The range of light distribution patterns achieved may be further widened by the use of different configurations for the reflector surfaces. All the reflectors in one luminaire may have identically-configured surfaces, but it is within the present invention for the reflectors to have different surface configurations and/or reflectivities.

A further widening of the range of light distribution patterns may also be achieved by allowing the position of the lamp holder, and hence the position of the lamp to be adjustable relative to the bracket 22 and to the frame 4.

The provision of more than four reflectors in one luminaire is also possible, to give a greater versatility to the range of light distribution patterns possible.

The frame 4 as shown in square in plan, and is able to be secured to a four-sided lantern 21 by means of screws (not shown) extending through the apertures 16 into tapped holes in the lantern body. The lantern body 21 comprises a metal or other framework 26 which has a base from which extends an electric cable 28 for the lamp circuitry. While each face of the lantern may have an individual pane of glass 30, it is preferred to insert into the framework a four-sided body of clear plastics material. The cap 24 is preferably pivotally mounted in body 21, so as to give ready access to the lampholder and reflectors.

I claim:

1. A luminaire comprising a frame, at least four reflectors mounted around an aperture in the frame to circumscribe a lamp position and to reflect light emitted from a lamp when in position, and in which the reflectors are pivotable, wherein each of the at least four reflectors is angularly adjustable about an axis extending perpendicularly to the frame and has a substantially-triangular base in slidable contact with one surface of an apertured base member of the frame.

2. A luminaire according to claim 1 further comprising a lamp holder arranged to locate a lamp substantially centrally to four reflectors arranged in a diamond shape around the lamp position.

3. A luminaire as claimed in claim 1 or 2 wherein at least one of the reflectors is adapted to be engaged by a lock member for preventing the reflector from pivoting about its pivot member.

4. A luminaire as claimed in claim 1 or 2 wherein the aperture in the base member is overarched by a bracket having ends which are fast with the frame and carrying a lampholder.

5. A luminaire as claimed in claim 1 or 2 wherein each reflector is of polished metal having two or more facets in the shape of a parallelogram.

6. A luminaire as claimed in claim 3 wherein the aperture in the base member is overarched by a bracket having ends which are fast with the frame and carrying a lampholder.

7. A luminaire as claimed in claim 3 wherein each reflector is of polished metal having two or more facets in the shape of a parallelogram.

8. A luminaire as claimed in claim 4 wherein each reflector is of polished metal having two or more facets in the shape of a parallelogram.

* * * * *